United States Patent [19]

Peev et al.

[11] 4,077,357

[45] Mar. 7, 1978

[54] APPARATUS FOR THE APPLICATION OF A PROTECTIVE COATING TO A GRAPHITE ELECTRODE

[75] Inventors: Vassil Georgiev Peev; Alexander Yordanov Valchev; Emil Pantaleev Ninov; Todor Yankov Koychev; Yordan Ivanov Krestenyakov; Hristo Nenchev Parashkevov; Avedis Mardik Dersarkisyan; Hristo Krumov Lyubenov; Borimir Nanov Nenov; Ivan Vassilev Genev, all of Sofia, Bulgaria

[73] Assignee: DSO "Cherna Metalurgia", Botunetz, Bulgaria

[21] Appl. No.: 655,264

[22] Filed: Feb. 4, 1976

[30] Foreign Application Priority Data

Feb. 12, 1975 Bulgaria ..... 28955

[51] Int. Cl.[2] ..... B05B 13/04

[52] U.S. Cl. ..... 118/321; 82/2 R; 118/503; 427/425

[58] Field of Search ..... 118/75, 47, 49.5, 310, 118/320, 321; 219/68, 76; 29/27 C, 28; 82/2 R, 31; 427/34, 37, 425, 28

[56] References Cited

U.S. PATENT DOCUMENTS

| | | | |
|---|---|---|---|
| 2,631,948 | 3/1953 | Belitz et al. | 118/320 X |
| 2,861,166 | 11/1958 | Cargill, Jr. | 219/68 |
| 3,019,014 | 1/1962 | Miksis | 427/425 X |
| 3,078,560 | 2/1963 | Vosburg | 82/2 R X |
| 3,190,156 | 6/1965 | Schuman | 82/2 R |
| 3,397,732 | 8/1968 | Howell, Jr. | 118/321 X |
| 3,476,586 | 11/1969 | Valtchev et al. | 427/37 |
| 3,493,415 | 2/1970 | Grisaffe et al. | 427/34 |
| 3,844,186 | 10/1974 | Youden et al. | 82/2 R |
| 3,864,164 | 2/1975 | Hinchcliffe et al. | 427/425 X |

*Primary Examiner*—Mervin Stein
*Attorney, Agent, or Firm*—Karl F. Ross

[57] ABSTRACT

An apparatus for coating graphite electrodes comprises a support having parallel horizontal guideways at one end of which is a fixed headstock whose spindle is coupled by gearing to a lead screw and is driven at a constant speed. At the other end of the guideways is a movable tailstock whose spindle is clamped by an electric motor and slip clutch against an electrode supported between the spindles. The lead screw drives a longitudinal slide which carries a plurality of cross-slides including a cleaning tool, a metal-depositing spray head, an arc-depositing head and a grinding device each on a respective cross-slide. The entire unit is enclosed in an acoustical housing having a lid which can be opened to permit lowering of the electrode into place and a door through which the operator can have access to the apparatus.

1 Claim, 2 Drawing Figures

APPARATUS FOR THE APPLICATION OF A PROTECTIVE COATING TO A GRAPHITE ELECTRODE

Figure 1:
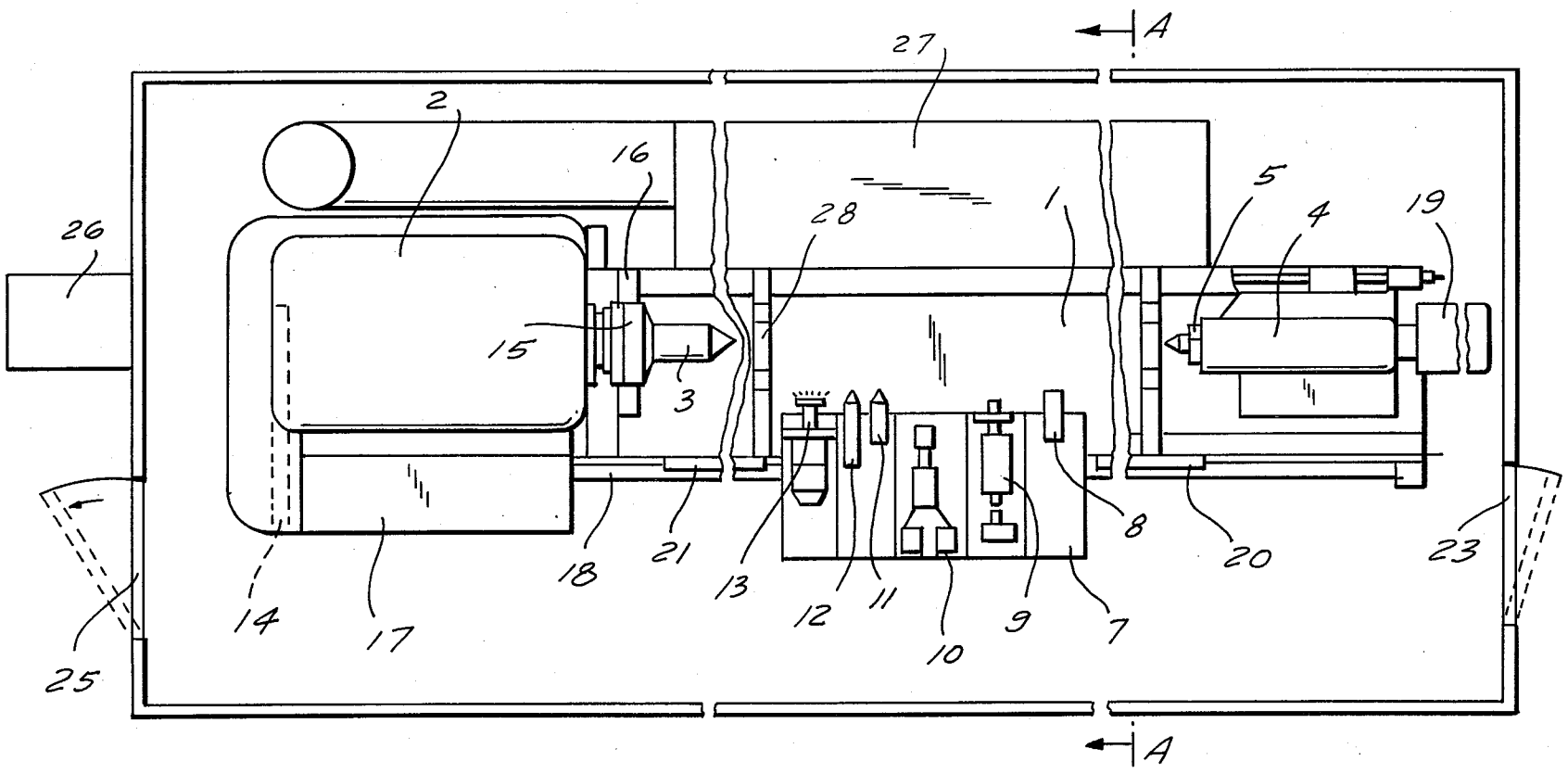

This invention relates to an apparatus for the application of a protective coating to a graphite electrode.

Such known apparatus has a support with parallel guideways, a fixed headstock with a spindle, a loose tailstock with a spindle and a longitudinal slide with a leadscrew. Two types of such machines are used: for metal spraying with aluminum and for electric-arc treatment, i.e. on the longitudinal slide of the first type of machine there are provided electric-arc metal spray-guns and, in the second type of machine, heads for electric-arc treatment. The drive of the spindle and the motion of the slide are effected by two D.C. motors with variable speed, without any kinematic link between both motions.

The main disadvantages of such apparatus are:

The electrodes are placed and removed by successive devices until the termination of the technological process, which results in a low labor productivity. The individual drive of the spindle and the slide without any kinematic link between them results in sizable deviations in the pitch. Special current rectifiers and a complex reliable automation system are necessary for regulating the process. The stopping of the processes at the end of the electrode is not automatic. The processes are noisy, reaching a level of 105 to 110 db.

In another known apparatus for the formation of protective coating, the electrode is placed onto two rows of rolls. The rolls of the one row are inclined at a determined angle and impart a rotary-translational motion to the electrode. This system has not been found to be reliable. The main difficulty lies in the supply of a current of 4000 to 5000 amperes to the body of the electrode. There also is not provided sufficient uniformity of the translational motion.

It is therefore an object of this invention to provide an apparatus for the purpose described, which can carry out all working operations one after the other without an intermediate removal of the electrode from the apparatus. Another object is to provide an apparatus which gives more stable revolution of the electrode and, what is more important, a constant pitch of the longitudinal slide. Also the apparatus must be totally automated, and the noise generated by the electric-arc treatment and the metal-spraying must be reduced to the standard requirements.

This is achieved, in accordance with the present invention, in an apparatus of the lathe type which comprises a body with parallel guideways, a fixed headstock with a spindle, a movable tailstock with a tail spindle and a longitudinal slide with a leadscrew. The longitudinal slide has several transverse slides, on which are disposed a device for the cleaning of the surface of the graphite electrodes, a head for electric-arc treatment, an electric metal-spraying gun for the application of aluminum by spraying in a molten state, a sprayer for applying a suspension of powdered alloying substances, a sprayer for applying a graphite suspension, and a grinding device. The apparatus has a main motor with constant speed, which is kinematically rigidly connected, in a known way, by means of gearboxes, with the spindle and the leadscrew of the longitudinal slide. The transmission ratios of the gearbox of the spindle are chosen so as to provide speeds inversely proportional to the diameter of the standard graphite electrodes.

Preferably the tail spindle is provided with an electric motor with a slip coupling and a switching device with two time relays. The tail spindle itself is connected in a known way to the sliding cam of the end circuit breakers. To reduce the noise of the technological process to the requirements allowable by the standards, the apparatus is disposed inside a noise-suppressing booth.

As compared with the known machines, the apparatus of the present invention features the following advantages:

For the production of the complete coating of one electrode, the graphite body is mounted in the apparatus only once, and not repeatedly.

The use of an asynchronous motor and the rigid kinematic link between the motor, the spindle and the leadscrew provide for much stabler speed of the electrode and an exact pitch, while, as on the known machines, the two individual variable-speed D.C. motors, one for the spindle and one for the slide, operate unsatisfactorily in this respect, which results in inadmissible deviations, mainly in the pitch. The problem of the tail spindle is particularly favorably solved, as well as of the electric clamp and the sliding cam for the end circuit breakers, whereby the operations are fully automated.

The noise of the technological processes is reduced to the requirements of the standards.

Figure 2:
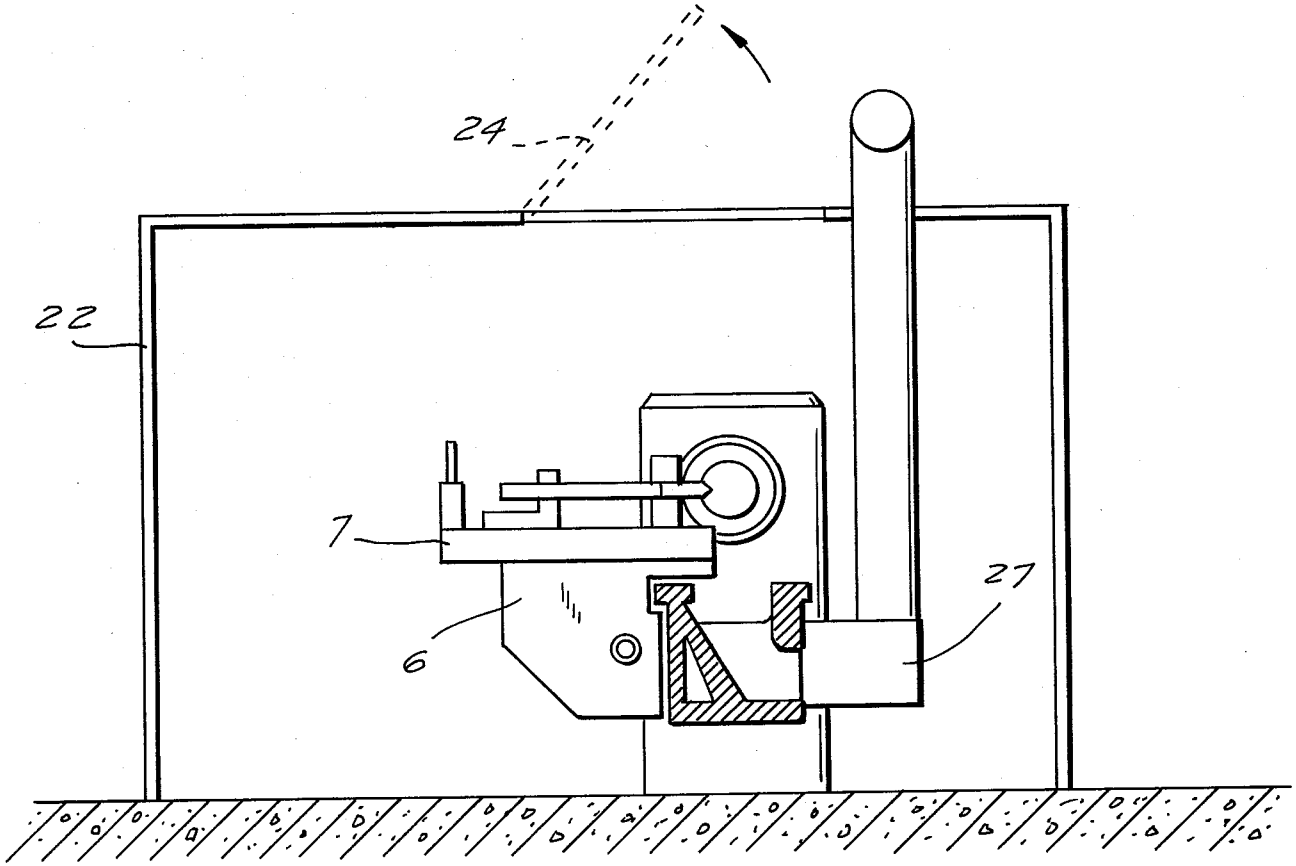

For a better understanding of the invention, reference should be made to the accompanying drawing in which there is illustrated a preferred embodiment of the invention. In the drawing:

FIG. 1 is a top view of an apparatus for the formation of a protective coating on graphite electrodes; and FIG. 2 is a cross-sectional view of the apparatus for the formation of a protective coating on graphite electrodes.

The apparatus comprises a body 1 with parallel guideways. It is provided with a fixed headstock 2 with a spindle 3, which is connected in a known way with a gearbox and imparts a rotary motion to the treated electrode. At the other end of the guideways there is a movable tailstock 4 with a tail spindle 5. The connection of the positive pole of the D.C. source to the treated electrode is effected by means of the spindle 3 and/or the tail spindle 5, which are equipped with a current pick-up copper ring 15 and contact brushes 16. The spindle 3 and the tail spindle 5 are electrically insulated with respect to the body 1. On the guideways there is disposed, on rollers, a longitudinal slide 6 which can move, by means of a leadscrew 18, translationally parallel to the axis of the electrode. On the longitudinal slide 6 there are five transverse slides (cross slides) 7, on which are disposed the treating tools and devices, namely: a device 8 for cleaning the graphite surface, a head 9 for electric-arc treatment, an electric-arc metal spray gun 10 for applying aluminum by spraying in a molten state, a sprayer 11 for applying a suspension of powdered alloying substances, a sprayer 12 for applying a graphite suspension, and a grinding device 13.

The apparatus has a main constant-speed motor, connected in a known way by means of the gearbox in headstock 2 to the spindle 3. The gearbox has a suitably chosen transmission ratio, so that the speed of spindle 3 is inversely proportional to the diameters of the standard graphite electrodes, i.e. the peripheral speed of electrodes of different diameters is nearly equal.

The gearbox of the headstock 2 is connected in a known way by means of gearing 14 to gearbox 17, which, on its part, drives the leadscrew 18 and provides for the translational motion of the longitudinal slide 6. The rigid kinematic link between gearbox 2 for the revolutions and gearbox 17 for the pitch provides for an exact maintenance of the preset pitch.

The motion of the tail spindle 5 is provided for by the electric motor 19 with a slip coupling, whereby a constant force of clamping the electrode is achieved. The switching-off of the electric motor 19 in both directions (i.e. clamping and release of the electrode) is effected by two time relays, this operation being semiautomatic. The tail spindle 5 is suitably connected to the sliding cam of the end circuit breakers 20 of the working devices disposed on the transverse slide 7. For electrodes of different length, the position of the tail spindle 5, when the electrode is clamped, is different. With the same difference in the position of the tail spindle 5, there is changed the position of the sliding cam 20, so that the latter provides for the switching-off of the working devices, disposed on the transverse slides 7, when the end of the electrode is attained, irrespective of their length.

All working devices, disposed on the transverse slides 7, have their own individual switching on and off devices, which are connected to electric switches of the corresponding working devices or with electromagnetic valves. In a clamped position, the front end of the electrodes near spindle 3 has always one and the same position.

The role of a sliding cam at the front end is performed by the fixed strip 21, which sequentially switches on each of the working devices when attaining the front end of the electrode. As already mentioned, when the end of the electrode is attained, the switching-off of these working devices is effected by the sliding cam 20.

The head 9 for electric-arc treatment has its own automatic system for maintaining a constant current and a constant voltage of the electric arc. The electric-arc spraying gun 10 has its own automatic system for maintaining a constant voltage of the electric arc by means of increasing or reducing the velocity of feed of the wire, i.e. by maintaining a constant length of the electric arc. The device for cleaning the surface of the electrodes 8 and the grinding device 13 are disposed on hydraulically driven transverse slides 7. By means of the switching on and off devices there is provided a simultaneous electric switching-on of these working devices and the displacement of their transverse slides forward up to a determined position and, respectively, their electrical switching-off and displacement of their transverse slides to back end position. The switching devices of sprayers 11 and 12 switch on and off the supply of compressed air toward them. Thus, each individual working stroke of the longitudinal slide 6, together with the transverse slides 7 and the working devices disposed on them is fully automated.

The technological processes electric-arc treatment and electric-arc metal spraying create a noise of about 110 db. For this reason there is provided a noise-absorbing booth, which is fabricated of metal sections and has at least one movable upper lid 24 and a door 23, through which the machine is charged with electrodes. It is advisable to provide one more door 25 for attending the machine, which should be disposed near the control panel 26 of the apparatus. The spaces between the metal sections of the booth are filled with noise-absorbing plates, thus reducing the noise level of the technological processes to the standard requirements.

During the three technological processes, i.e. cleaning of the electrode surfaces, electric-arc metal spraying of aluminum and grinding, a considerable quantity of dust is produced, which is in the area of the tips about 250 grams of powder per minute. For the exhaustion of this dust the apparatus is connected with an exhausting installation 27.

For compactness of the apparatus, it is preferred to connect the working devices on the transverse slides with the supplying circuits (operative, driving, compressed air, water, etc.) by means of cable.

The operation of the apparatus is explained by means of the following example:

Into both nipple seats of the electrode there are screwed pins, which are used for conveying by material-handling equipment and for gripping the electrode between the spindle 3 and the tail spindle 5 of the apparatus. The electrode is lifted by a bridge crane. While the door 23 and the lid 24 are opened, it is introduced inside the booth 22, and the journals of the pins are seated on the supports 28. The electric motor is switched on for forward motion, the tail spindle 5 enters the back pin and pushes the electrode toward the spindle 3. At that, the cones of spindle 3 and tail spindle 5 and the female cones of the pins lift the journals of the pins off the supports 28. At a preset torque, the coupling of the electric motor 19 slips, and shortly after that the time relay switches off the motor.

For the formation of the coating, the longitudinal slide 6 performs four working strokes:

First stroke: cleaning of the electrode surface, spraying with aluminum, first spraying with a suspension of compositions of alloying elements, fast return;

Second stroke: first electric-arc treatment, second spraying with aluminum, second spraying with a suspension of alloying elements, fast return;

Third stroke: second electric-arc treatment, third spraying with aluminum, spraying with a graphite suspension, fast return;

Fourth stroke: third electric-arc treatment, grinding the surfaces, fast return.

Then follows the release stroke of the electric motor, when the journals of the pins are seated again on supports 28. The upper lid 24 and the door 23 are opened and the complete electrode is carried by means of a crane out of the booth 22.

What we claim is:

1. An apparatus for applying a protective coating to an elongated electrode comprising:

an accoustic housing having walls, a door affording access to the interior by an operator, and a lid openable to permit the lowering of an electrode into said housing;

a support in said housing formed with horizontal parallel guideways;

a headstock fixed at one end of said support in said housing and being provided with a first spindle;

a tailstock disposed along said guideways and spaced from said support, said tailstock being formed with a second spindle, an electric motor, and a slip coupling between said electric motor and said second spindle for advancing said second spindle toward said first spindle and clamping an electrode therebetween with a predetermined clamping force;

a lead screw extending along said guideways;

gearing operatively connecting said first spindle to said lead screw for driving said lead screw at a speed in a predetermined ratio to the speed of said first spindle;

a constant-speed motor operatively connected to said first spindle for rotating same at a fixed speed;

a longitudinal slide on said guideways coupled with said lead screw for displacement thereby;

first, second, third, fourth and fifth cross-slides on said longitudinal slide operable independently of one another;

electrode cleaning means on said first cross-slide for cleaning an electrode supported on said spindles and preparing same to receive a coating;

electric-arc means on said second cross-slide for subjecting an electrode supported on said spindle to an electric-arc treatment;

metal-spray means on said third cross-slide for spraying molten metal on an electrode supported between said spindles;

coating-spray means on said fourth cross-slide for spraying a further coating material on an electrode supported between said spindles;

grinding means on said fifth cross-slide for grinding the surface of an electrode supported on said spindles; and control means for operating said electric motor to clamp an electrode between said spindles, repeatedly displacing said longitudinal slide along said guideways in a forward and in a return direction while an electrode is clamped between said spindles, successively advancing said first, said second, said third, said fourth and said fifth cross-slide for respective operation during movement of said longitudinal slide in successive forward directions, and thereafter reversing said electric motor to unclamp an electrode from between said spindles.

* * * * *